US006003619A

United States Patent [19]

Lange

[11] Patent Number: 6,003,619

[45] Date of Patent: Dec. 21, 1999

[54] BACK DRIVING AUTOMATIC HAMMER

[76] Inventor: James E. Lange, P.O. Box 1670, LaPorte, Ind. 46350

[21] Appl. No.: 09/086,370

[22] Filed: May 28, 1998

[51] Int. Cl.[6] ..... E21B 7/02

[52] U.S. Cl. ..... 173/184; 173/28; 173/29; 173/89; 173/91; 173/132

[58] Field of Search ..... 173/184, 185, 173/28, 89, 84, 131, 132, 129, 29, 90, 91, 53, 54, 55, 147; 254/29 R, 30

[56] References Cited

U.S. PATENT DOCUMENTS

| | | | |
|---|---|---|---|
| 1,024,173 | 4/1912 | Betts | 173/91 |
| 1,213,989 | 1/1917 | Wilson | 173/91 |
| 3,205,952 | 9/1965 | Sicotte | 173/132 |
| 4,405,020 | 9/1983 | Rassieur | 173/89 |
| 4,993,500 | 2/1991 | Greene et al. | 173/28 |
| 5,647,442 | 7/1997 | Lange | 173/28 |

*Primary Examiner*—Peter Vo
*Assistant Examiner*—James P. Calve
*Attorney, Agent, or Firm*—Baker & Daniels

[57] ABSTRACT

A driver hammer for driving an elongated member into the earth and for extracting the member from the earth includes a hammer body and a forward driving anvil slidably mounted in the body that is engaged directly with the elongated member when the latter is driven into the earth. A conventional hammer drive mechanism is used to repeatedly impact the forward driving anvil to drive the member into the earth. When the member is to be extracted from the earth, a back driving lever, which is pivotally mounted on the hammer body, is pivoted into the position where the forward driving anvil can strike an impact surface on one side of the pivot point of the lever and a back driving anvil is engaged with a second impact surface on the opposite side of the pivot point of the lever and which is attached to the elongated member. Accordingly, the forward driving anvil repeatedly strikes the first impact surface, thereby causing the second impact surface to pivot upwardly and impact the back driving anvil, which extracts the member from the earth.

9 Claims, 4 Drawing Sheets

BACK DRIVING AUTOMATIC HAMMER

BACKGROUND OF THE INVENTION

This invention relates to an automatic hammer for driving elongated members into the earth and for extracting such members from the earth.

Earth probing for environmental and geotechnical soil sampling has become increasingly necessary. Samples may be taken by drilling into the earth and taking samples at predetermined depths, or by driving samplers into the earth. Where possible, driving samplers directly is usually less expensive and more convenient than drilling. Samplers, rod, casing or other members are hammered into the earth by automatic hammers that apply impact forces to the member in a downwardly acting motion. However, samplers and other members driven into the earth in this way must usually also be removed. Existing automatic hammers are not capable of driving a sampler in both a downward direction and an upward direction. Several devices such as hoists, hydraulic cylinders, etc., are used to apply a steady, upward force to remove an object from the earth. However, impact force is more effective than a steady force in removing stuck objects from the earth.

One prior art method of driving samplers, rod, casing or other members into the ground employs a cathead (or power rotating drum) and rope to raise and drop a hammer. An operator engages the rope which is connected to the drop weight with the rotating drum. The drum raises the drop weight to a predetermined height, at which time the operator releases the rope to allow the drop weight to drop and thus impact the object being driven into the ground. Catheads may also be used to provide an upwardly directed impact force to drive members out of the ground. Catheads are dangerous to operate and must be used by skilled operators only. Their use has largely been replaced by the automatic hammer to drive members into the ground, which is a safer, more accurate method of driving rods, samplers, casing or other members into the ground. But since these automatic hammers are not capable of back driving, many rigs are still equipped with catheads for back driving.

SUMMARY OF THE INVENTION

The present invention provides an automatic hammer capable of both driving members into the ground and back driving or moving members from the ground by impact forces. A typical prior art drive hammer, which is capable of driving members in only one direction, is disclosed U.S. Pat. No. 4,405,020. According to the resent invention, a back driving lever is pivotally mounted on the hammer body. When a member is to be extracted from the earth, the lever is swung into a position in which an impact surface on the lever is struck with the forward driving anvil, thus transmitting an upward impact force on a back driving anvil engaging another impact surface on the other side of the lever pivot point. The back driving anvil is connected to the member being extracted.

BRIEF DESCRIPTION OF THE DRAWINGS

These and other present inventions will become apparent from the following description, with reference to the accompanying drawings, in which.

DETAILED DESCRIPTION OF THE INVENTION

Figure 1:
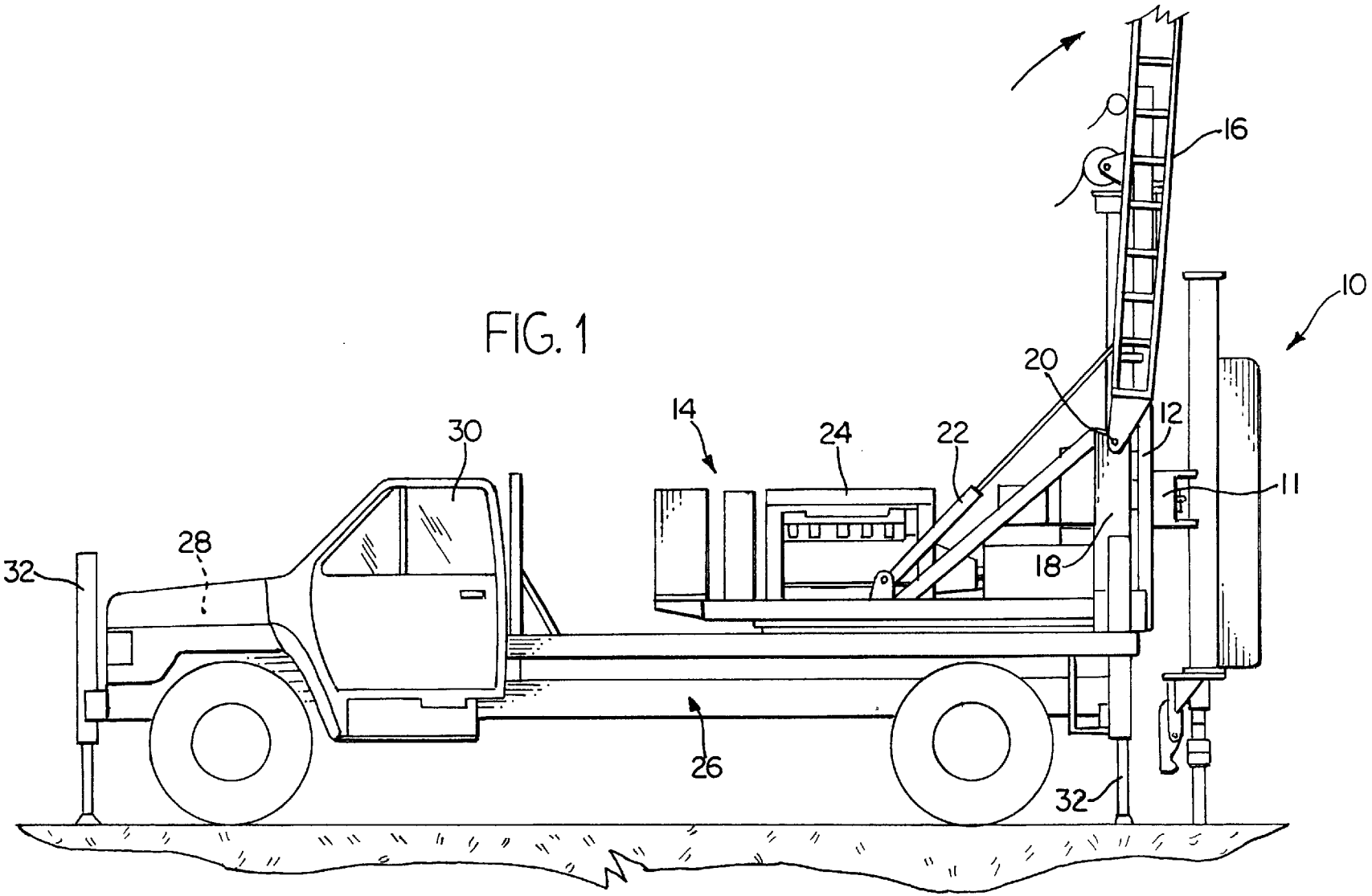
FIG. 1 is a side elevational view of a rig carrying a drive hammer made pursuant to the teachings of the present invention.
Figure 2:
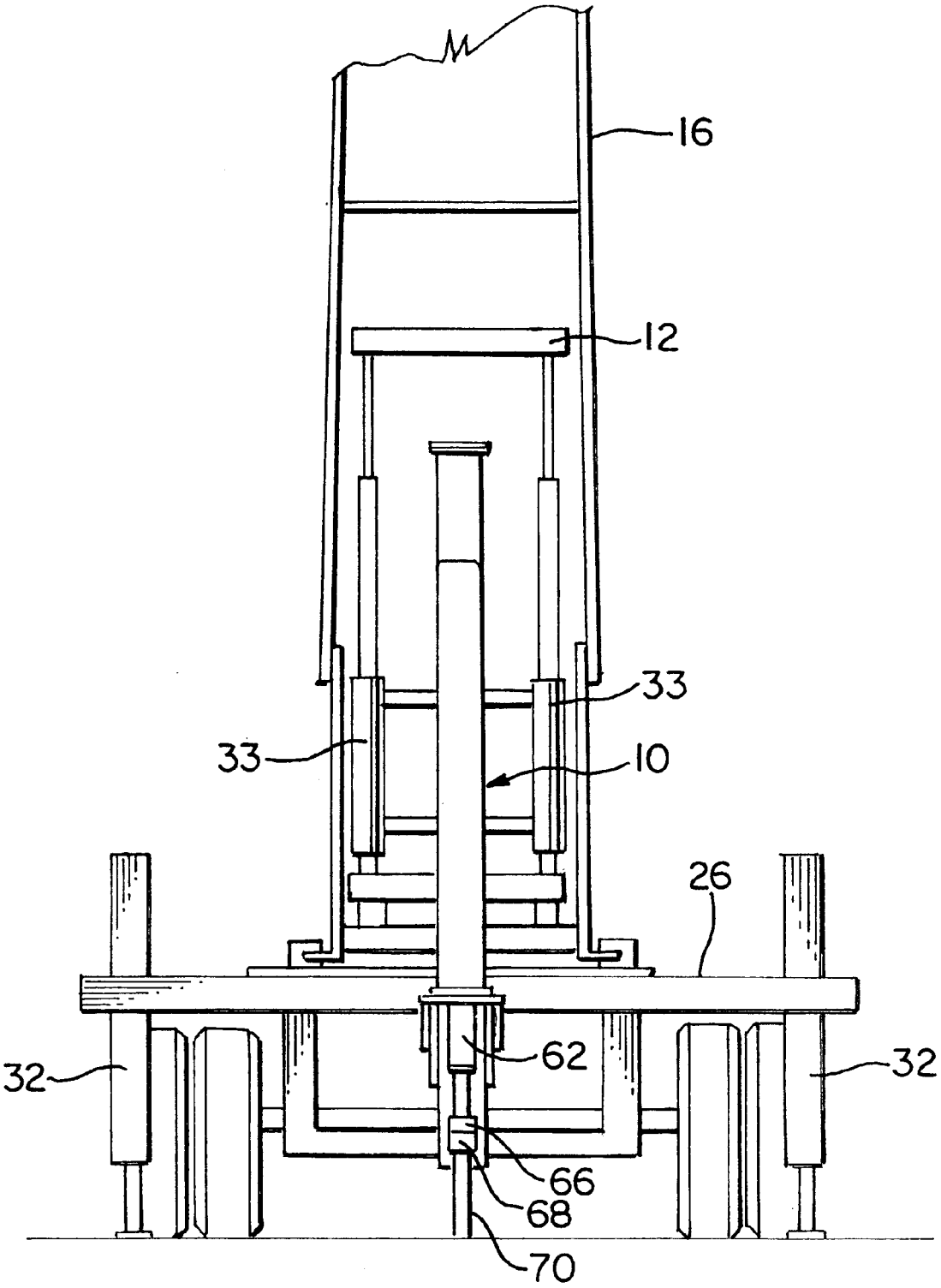
FIG. 2 is a rear elevational view of the rig illustrated in FIG. 1.

Referring now to the drawings, a drive hammer generally indicated by the numeral 10 made pursuant to the teachings of the present invention is mounted on a rotary box 11 mounted on feed frame 12 of a drill rig generally indicated by the numeral 14. The rotary box 11 and drive hammer 10 are raised and lowered with the feed frame 12 of drill rig 14. The feed frame 12 is pivotally connected to support arms 18 through a pivot connection 20. Hydraulic cylinders 22 are used to raise the feed frame 12 and with it the mast 16, rotating box 11 and drive hammer 10 to the vertical position to effect probing. The mast 16, feed frame 12, and drive hammer 10 may be lowered to a substantially horizontal orientation for road travel by operation of hydraulic cylinders 22, in a manner well known to those skilled in the art. Since the rig 14 may also be used to effect conventional rotary drilling, the rig 14 is equipped with a conventional engine 24, which may be used in a manner well known to those skilled in the art to operate rotary drilling equipment. The drill rig 14 is mounted on a conventional chassis 26 of a medium duty truck, which is equipped with a conventional engine compartment 28 and drivers cab 30, to permit the chassis 26 to be driven from place to place after the mast 16, feed frame 12, rotary box 11 and drive hammer 10 are lowered into the aforementioned horizontal position. Conventional ground engaging stabilizers 32 are provided to stabilize the rig 14 at the work site. The feed frame 12 is equipped with conventional hydraulic cylinders 33 which are used to raise and lower the rotary box 11 and drive hammer 10 relative to the chassis 26.

Figure 3:
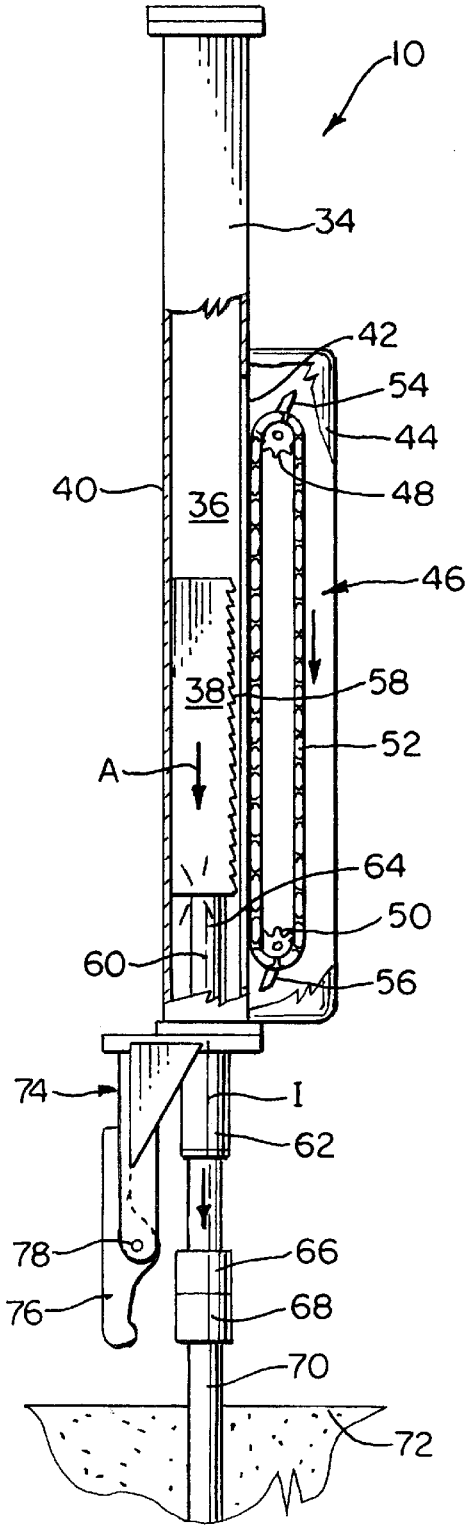
FIG. 3 is an enlarged view, partly in section, of the drive hammer illustrated in FIG. 1 configured to drive members into the earth.
Figure 4:
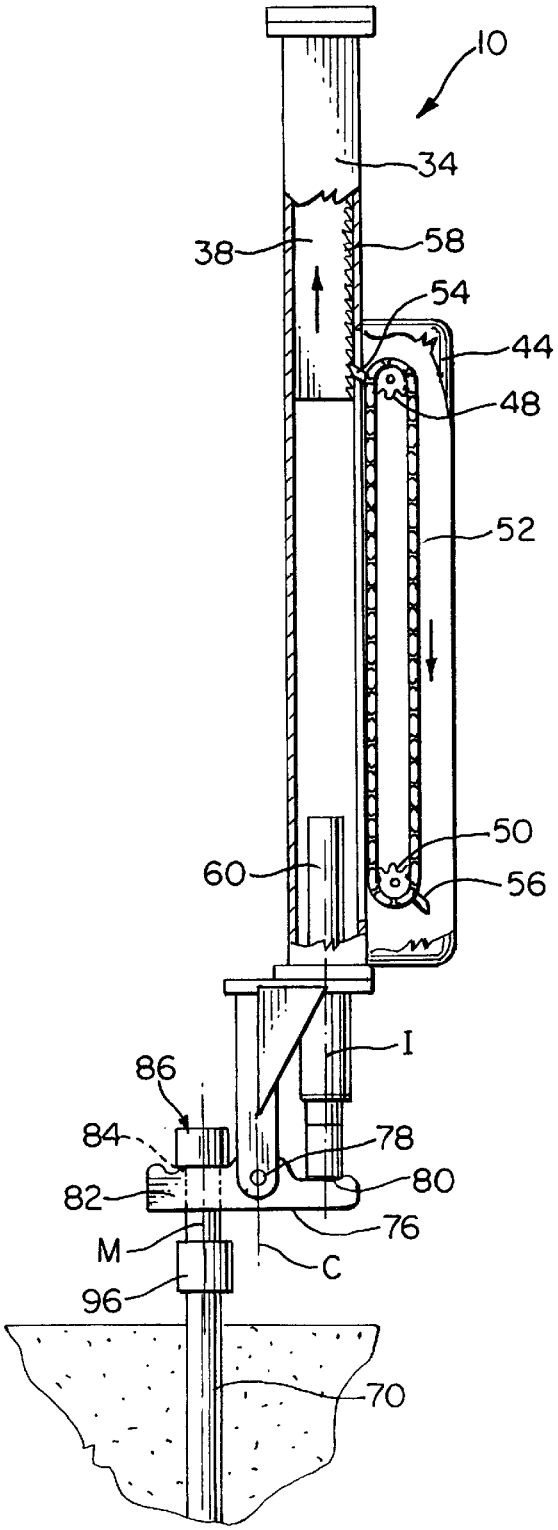
FIGS. 4 and 5 are views similar to FIG. 3, but illustrating the drive hammer of the present invention configured to extract members from the earth.

Referring now to FIG. 3, drive hammer 10 includes a body 34 defining a chamber 36 therewithin. A drop weight 38 is slidably mounted in the chamber 36 for upward and downward relative movement with respect thereto. Body 34 includes an outer wall 40. The wall 40 is equipped with an axially extending slot 42 which opens into drive housing 44, which is secured to the wall 40. A drive mechanism generally indicated by the numeral 46 is mounted within the drive housing 44 and includes a pair of sprockets 48, 50 that are spaced apart parallel to the axis of the drop weight 38 and a chain 52 that extends around the sprockets 48, 50. A drive motor (not shown) rotates the sprockets 48, 50 to drive the chain 52. A pair of lifting dogs 54, 56 project outwardly from the chain 52 and are spaced about midway around the chain 52 from each other. The lifting dogs are adapted to engage lifting rack 58 mounted on the weight 38 to raise the latter from the lower position illustrated in FIG. 3 to the uppermost position illustrated in FIG. 4, whereupon the lifting dog releases the weight as the lifting dog moves through the slot 42 back into the drive housing 44. Accordingly, the weight 38 drops downwardly. A forward driving anvil 60 is slidably mounted in reduced diameter portion 62 of body 34 and includes an impact end 64 which extends into the chamber 36 and is impacted by the weight 38.

A connector 66 is mounted on the end of the forward driving anvil 60 opposite impact end 64. This opposite end projects from the lowermost end of the reduced portion 62 of the body 34. The fitting 66 couples with a corresponding fitting 68 which is secured to an elongated member 70 which is to be driven into the earth indicated at 72. The elongated member 70 may be, for example, a sampler that is used for environmental sampling or geotechnical exploration, but may also be any other elongated member, such as a sign post, flag pole, etc., which is to be driven into the ground.

When the member 70 is to be driven into the earth, couplings 66, 68 are connected together, and the drive mechanism 46 is started, so that the sprockets 48, 50 rotate the chain 52. As the chain rotates, one of the dogs 54 or 56 is rotated through the slot 42 and engages the lifting rack 58 of the drop weight 38, thereby lifting it as the chain 52 continues to rotate. When the drop weight 38 is lifted to the uppermost position illustrated in FIG. 4, the lifting dog that has engaged with the lower surface 58 moves through the slot 42, thereby releasing the drop weight 38, causing it to travel downwardly as indicated by the arrow "A" to impact the impact end 64 of the forward driving anvil 60. This impact is transmitted through the forward driving anvil 60 to the elongated member 70, thereby driving the elongated member 70 into the ground.

It is also necessary that elongated members, such as the member 70, be removed from the ground. As discussed above, although a steady pressure, such as that applied by the hydraulic cylinders 33 of the feed frame 12, may be effective in forcing the elongated members upwardly, such members often become stuck and steady pressure, such as that applied by the cylinders or through a hoist, etc., is ineffective in forcing the elongated member out of the ground. In breaking members loose that have become stuck in the ground, an impact force is often much more effective than a steady applied force. According to the present invention, an impact back driving force is applied to break member 70 loose and to raise it out of the ground. It will be noted that as the member 70 is driven into the ground by the impact forces generated by the drop weight 38, the lifting dogs 54, 56 engage successively higher teeth on the lifting rack 54 as the member 70 is driven into the ground.

Figure 5:
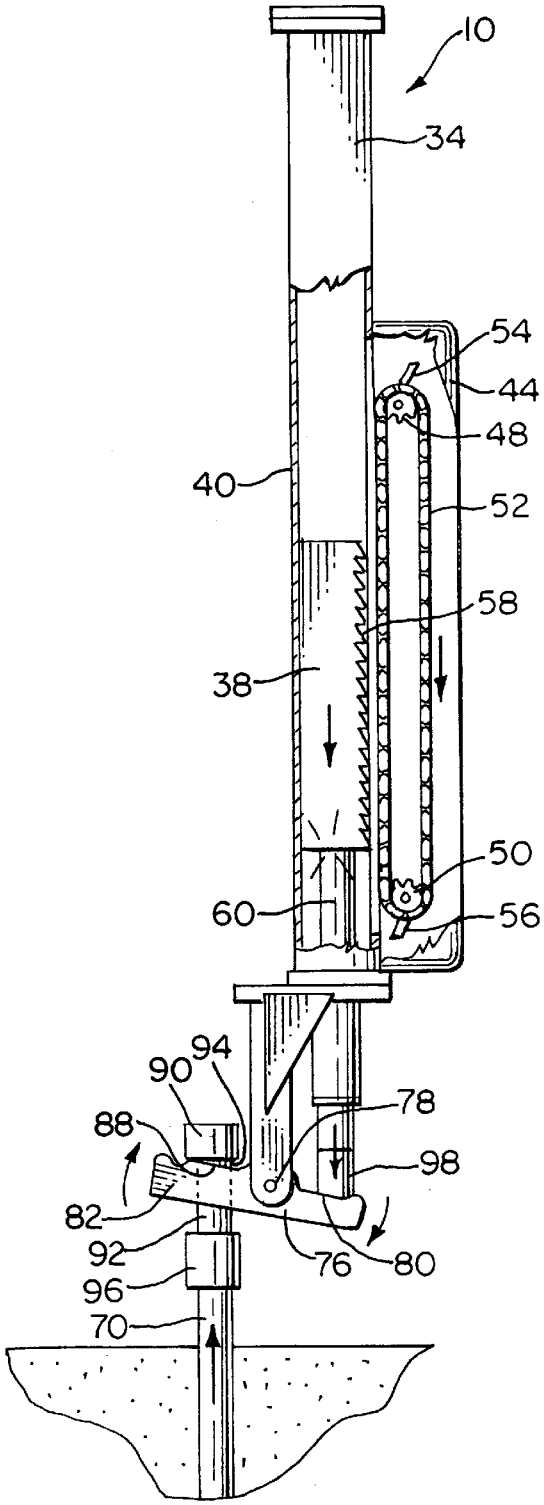

According to the invention, a back driving lever mount generally indicated by the numeral 74 is rigidly secured to the body 34 of the drive hammer 10. A back driving lever 76 is pivotally mounted on the lever mount 74 for pivotal movement about a pivot pin 78. Accordingly, the back driving lever 76 pivots between an inactive position illustrated in FIG. 3 in which the lever 76 is displaced from the line of action "l" of the drive anvil 60 to permit the forward driving anvil 60 to impact the elongated member 70 directly to drive the latter into the earth, to an active position illustrated in FIGS. 4 and 5, in which the lever 76 intersects the line of action "l" of the forward driving anvil 60, such that the forward driving anvil can impact a first impact surface 80 on one end of the back driving lever 76. The other end of the back driving lever 76 is a forked end 82 defining a slot 84 receiving a back driving anvil generally indicated by the numeral 86. A second impact surface 88 is defined on the forked end 82 on opposite sides of the slot 84. The back driving anvil 86 includes a head 90 cooperating with a shank 92 to define a shoulder 94 therebetween that engages the second impact surface 88. The shank 92 extends through the aforementioned slot and is connected with the elongated member 78 that is to be removed from the ground through a conventional connector 96. The connector 66 mounted on the end of the forward driving anvil 60 when elongated members 70 are driven into the ground is removed and is replaced with a cap 98 for engagement with the first impact surface 80. It will be noted that the distance between the line of action "l" of the forward driving anvil 60 and the center line "c" of the pivot 78 is about 25 percent greater than the distance between the center line "c" and the line of action "m" of the back driving anvil 86. Accordingly, due to the difference in lever arms, the force applied to the back driving anvil 86 is about 25 percent greater than the force applied by the forward driving anvil 60 to the lever 76.

When an elongated member 70 is to be removed from the earth, the rig 14 is positioned such that the back driving anvil 86 can be installed on the back driving lever 76 and also connected to the elongated member 70 through the connecting member 96. The cap 98 is then installed on the forward driving anvil 60, and the drive mechanism 46 is then used to operate the forward driving anvil 60 so that repeated blows by the drop weight 38 on the forward driving anvil 60 are transmitted from a downwardly acting force exerted through the forward driving anvil 60 to an upwardly acting force applied to the back driving anvil 86 due to pivoting of the lever 76 about the pivot 78. If necessary, the position of the drive lever 10 can be raised by operation of the aforementioned hydraulic cylinder as the member 70 is extracted from the earth. After the member 70 has been broken loose, steadily applied pressure may be exerted to lift the member out of the earth.

What is claimed is:

1. Mechanism for driving an elongated member into the earth and for extracting said elongated member from the earth, comprising a hammer body, a forward driving anvil slidably mounted in said body engaging the elongated member when the latter is driven into the earth, a back driving lever pivotably mounted on said hammer body at a pivot point, said forward driving anvil engaging said back driving lever and pivoting said back driving lever about said pivot point when the elongated member is removed from the earth, a hammer driver mechanism for driving said forward driving anvil, one end of said back driving lever having a first impact surface for engagement by said forward driving anvil, the other end of said lever having a second impact surface engaging a back driving anvil connected to said member when the member is removed from the earth, said hammer body including a back driving lever mount, a pivot pin connecting said back driving lever to said back driving lever mount at said pivot point, said back driving lever pivoting about said pivot point between an active position in which said first impact surface is in registry with said forward driving anvil and an inactive position in which said first impact surface is displaced from the forward driving anvil to permit said forward driving anvil to engage the elongated member.

2. Mechanism as claimed in claim 1, wherein the distance between the pivot point and a first line of motion through which the forward driving anvil acts is greater than the distance between the pivot point and a second line of motion through which the back driving anvil acts.

3. Mechanism as claimed in claim 1, wherein said forward driving anvil acts through a line of motion extending through said member when the forward driving anvil drives said elongated member into the earth, said lever pivoting about said pivot connection between an inactive position displaced from said line of motion when the member is driven into the earth and an active position registering with the line of motion when the member is extracted from the earth.

4. Mechanism for driving an elongated member into the earth and for extracting said elongated member from the earth, comprising a hammer body, a forward driving anvil slidably mounted in said body engaging the elongated member when the latter is driven into the earth, a back driving lever pivotably mounted on said hammer body at a pivot point, said forward driving anvil engaging said back driving lever and pivoting said back driving lever about said pivot point when the elongated member is removed from the earth, a hammer driver mechanism for driving said forward driving anvil, one end of said back driving lever having a first impact surface for engagement by said forward driving anvil, the other end of said lever having a second impact surface engaging a back driving anvil connected to said member when the member is removed from the earth, the distance between the pivot point and a first line of motion through which the forward driving anvil acts being greater than the distance between the pivot point and a second line of motion through which the back driving anvil acts, said back driving anvil including a shoulder engaging said second impact surface, a shank extending from said shoulder through said lever, said shank terminating in a connection mechanism for connecting said back driving anvil to said elongated member.

5. Mechanism for driving an elongated member into the earth and for extracting said elongated member from the earth, comprising a hammer body, a forward driving anvil slidably mounted in said body engaging the elongated member when the latter is driven into the earth, a back driving lever pivotally mounted on said hammer body at a pivot point, said forward driving anvil engaging said back driving lever and pivoting said back driving lever about said pivot point when the elongated member is removed from the earth, a hammer drive mechanism for driving said forward driving anvil, one end of said back driving lever having a first impact surface for engagement by said forward driving anvil, the other end of said lever having a second impact surface engaging a back driving anvil connected to said member when the member is removed from the earth, said back driving anvil including a shoulder engaging said second impact surface, a shank extending from said shoulder though said lever, said shank terminating in a connection mechanism for connecting said back driving anvil to said elongated member.

6. Mechanism as claimed in claim 5, wherein said second impact surface is defined on a forked end of the lever, said shank extending through a gap defined on said forked end of the lever.

7. Mechanism for driving an elongated member into the earth and for extracting said elongated member from the earth, comprising a hammer body, a forward driving anvil slidably mounted in said body engaging the elongated member when the latter is driven into the earth, a back driving lever pivotably mounted on said hammer body at a pivot point, said forward driving anvil engaging said back driving lever and pivoting said back driving lever about said pivot point when the elongated member is removed from the earth, a hammer driver mechanism for driving said forward driving anvil, one end of said back driving lever having a first impact surface for engagement by said forward driving anvil, the other end of said lever having a second impact surface engaging a back driving anvil connected to said member when the member is removed from the earth, said forward driving anvil including a connecting end for connecting said forward driving anvil to said elongated member when the forward driving anvil drives said elongated member into the earth, and a removable cap covering said connecting end when the forward driving anvil engages said first impact surface when the elongated member is removed from the earth.

8. Mechanism for driving an elongated member into the earth and for extracting said elongated member from the earth, comprising a hammer body, a forward driving anvil slidably mounted in said body for engagement with an end of the elongated member when the latter is driven into the earth, a hammer driver mechanism for driving said forward driving anvil, a back driving anvil connected to said elongated member when the latter is to be extracted from the earth, and a force transfer mechanism transferring impact forces of the forward driving anvil to the back driving anvil to drive the back driving anvil in a direction opposite the forward driving anvil to thereby extract said member from the earth, said force transfer mechanism being a lever pivotally mounted on said body for pivotal movement about a pivot point, said forward driving anvil acting through a first line of motion and said back driving anvil acts through a second line of motion offset from said first line of motion, said lever extending between said first and second lines of motion, said pivot point being between said lines of motion to drive the back driving anvil in a direction opposite that of the forward driving anvil, the distance between the pivot point and said first line of motion through which the forward driving anvil acts being greater than the distance between the pivot point and said second line of motion through which the back driving anvil acts, said back driving anvil including a shoulder engaging said second impact surface, a shank extending from said shoulder through said lever, said shank terminating in a connected mechanism for connecting said back driving anvil to said elongated member.

9. Mechanism for driving an elongated member into the earth and for extracting said elongated member from the earth, comprising a hammer body, a forward driving anvil slidably mounted in said body for engagement with an end of the elongated member when the latter is driven into the earth, a hammer driver mechanism for driving said forward driving anvil, a back driving anvil connected to said elongated member when the latter is to be extracted from the earth, and a force transfer mechanism transferring impact forces of the forward driving anvil to the back driving anvil to drive the back driving anvil in a direction opposite the forward driving anvil to thereby extract said member from the earth, said force transfer mechanism being a lever pivotally mounted on said body for pivotal movement about a pivot point, said forward driving anvil including a connecting end for connecting said forward driving anvil to said elongated member when the forward driving anvil drives said elongated member into the earth, and a removable cap covering said connecting end when the forward driving anvil drives said lever to extract said member from the earth.

* * * * *